United States Patent [19]

Otsuka

[11] 4,065,215

[45] Dec. 27, 1977

[54] WRITING INSTRUMENT

[75] Inventor: Katsumi Otsuka, Funabashi, Japan

[73] Assignees: Toplan Manufacturing Inc.; Teibow Company Limited, both of Japan

[21] Appl. No.: 648,840

[22] Filed: Jan. 14, 1976

[30] Foreign Application Priority Data

Jan. 14, 1975 Japan ..... 50-7783[U]

[51] Int. Cl.[2] ..... B43K 8/00

[52] U.S. Cl. ..... 401/199; 401/292

[58] Field of Search ..... 401/198, 199, 265, 292, 401/282–284

[56] References Cited

U.S. PATENT DOCUMENTS 3,614,247 10/1971 Otsuka ..... 401/199

FOREIGN PATENT DOCUMENTS 1,903,452 10/1970 Germany ..... 401/292

*Primary Examiner*—Stephen C. Pellegrino

*Attorney, Agent, or Firm*—Irving M. Weiner; Pamela S. Austin

[57] ABSTRACT

An improved writing nib for a writing instrument comprising a cylindrical casing having an ink reservoir therein. Said nib has an inner capillary conduit which forms, in a transverse cross section of the nib, at least one straight slit which extends from the center of the cross section toward the outer periphery of said nib substantially in the radial direction of the cross section, and forms a plurality of radially spaced-apart arc shaped slits which are coaxial with each other about said center, a part of each of said arc shaped slits being interconnected with said straight slit.

4 Claims, 5 Drawing Figures

WRITING INSTRUMENT

FIELD OF THE INVENTION

The present invention relates to a writing instrument such as a sign pen or a marking pen, provided with an improved writing nib made of synthetic resin materials.

BACKGROUND OF THE INVENTION

A writing nib to be attached to a writing instrument such as a sign pen or marking pen for providing letters which are uniform in thickness from beginning to end regardless of the angle between the nib and the paper, should satisfy the following demands:

1. It should provide a nib having a fine diameter, since abrasion of the tip of said nib is inevitable.

2. A sufficient capillary action should be provided when writing. This can be attained by making the ink conduit very fine, but in order to maintain a sufficient amount of ink in said fine conduit to prevent "scratching", it is necessary to enlarge the total cross section of the conduit.

3. In order to provide a nib which is easy to write with, the tip portion of the nib should have a sufficient bending strength.

The applicant already has proposed writing instruments each provided with a writing nib of the above-mentioned type. In U.S. Pat. No. 3,614,247 the nib has a capillary conduit forming a snow flake shape in transverse cross section thereof. In U.S. Pat. No. 3,520,629 the nib has a capillary conduit forming a star shape in transverse cross section thereof.

However, these known nibs do not satisfy all of the above-mentioned demands (1), (2) and (3).

SUMMARY OF THE INVENTION

An object of the present invention is to provide a writing instrument which effectively satisfies the above-mentioned demands.

The writing instrument according to the invention comprises a cylindrical casing having a rear end and a forward end, an ink reservoir in said casing, and a writing nib having its rear end in said ink reservoir and its forward end projecting from the forward end of said casing, said nib having a tip portion extending forwardly from said forward end of the casing, and having an inner capillary conduit which extends axially through said nib;

the improvement wherein said inner capillary conduit forms, in a transverse cross section of the nib, at least one straight slit which extends from the center of the cross section toward the outer periphery of the nib substantially in the radial direction of said cross section, and forms a plurality of radially spaced apart arc shaped slits which are coaxial with each other about said center, a part of each of said arc shaped slits being interconnected with said straight slit.

BRIEF DESCRIPTION OF THE DRAWINGS

Further features and advantages of the present invention will be more apparent from the following description, reference being made to the accompanying drawings in which.

DETAILED DESCRIPTION OF THE PREFERRED EMBODIMENTS

Figure 1:
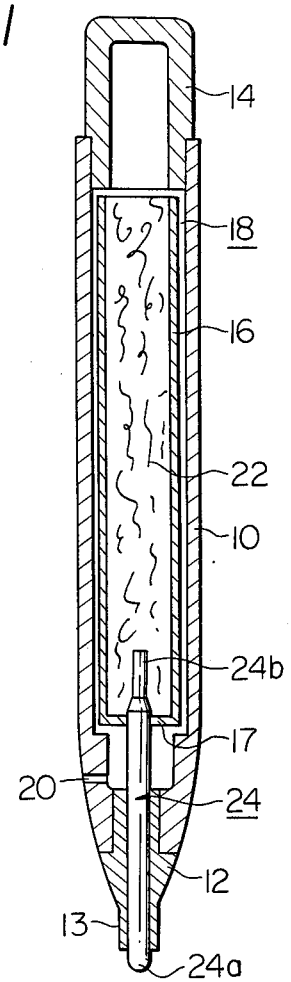
FIG. 1 is a side cross-sectional view of the writing instrument of the present invention.

Referring to FIG. 1, the writing instrument of the present invention has a cylindrical casing 10 having a rear end and a forward end. A nib holder 12 is fixedly mounted to the forward end of said casing 10 and a cap 14 is detachably push-mounted to the rear end of said casing 10. An ink reservoir 16 is housed in a space 18 which is defined by the interior of the casing 10. A vent hole 20 which allows atmospheric pressure to enter said space 18 is provided in the wall of the casing 10 adjacent to said nib holder 12. The ink reservoir 16 includes a cylindrical fibrous block 22, in which ink is reserved. Said ink reservoir 16 is inserted into the cylindrical casing 10 through a rear end aperture thereof. After completion of the insertion of ink reservoir 16, cap 14 is attached to the rear end of said casing 10.

A writing nib 24 according to the invention is fixedly mounted to the nib holder 12. The rear end **24*b* of said writing nib 24 is inserted into an end wall 17 of the ink reservoir 16, and extends into the interior space of said reservoir 16 so as to introduce ink contained in the fibrous block 22 into the nib 24. The forward end 24*a* of the nib 24 extends out of the forward portion 13 of the nib holder 12. Said nib 24** is made of a certain thermoplastic synthetic resin, and has an improved construction as will be described hereinafter.

Figure 2:
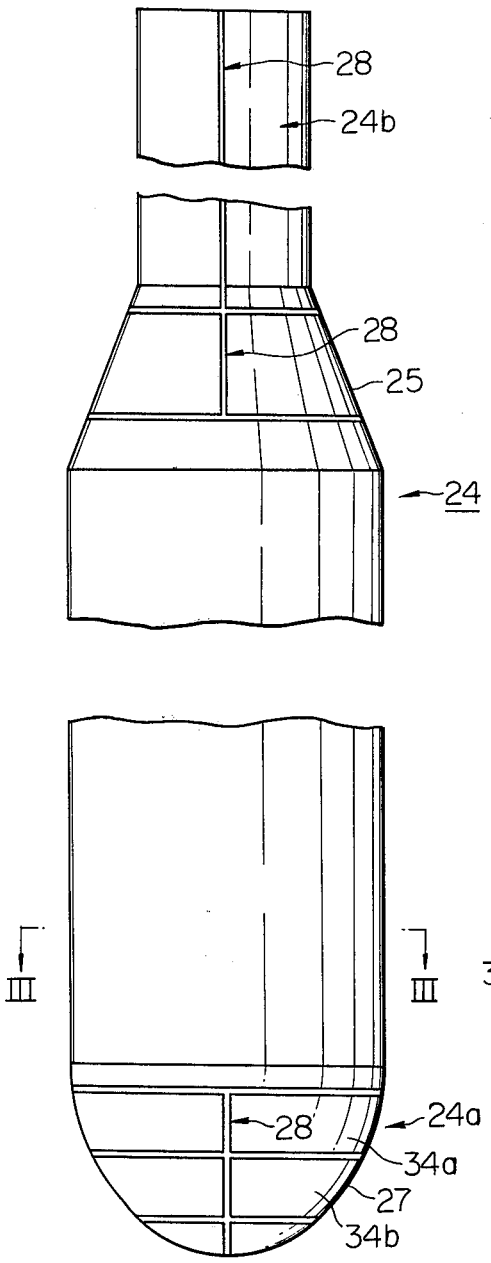
FIG. 2 is an enlarged side elevational view of the writing nib of the present invention.
Figure 3:
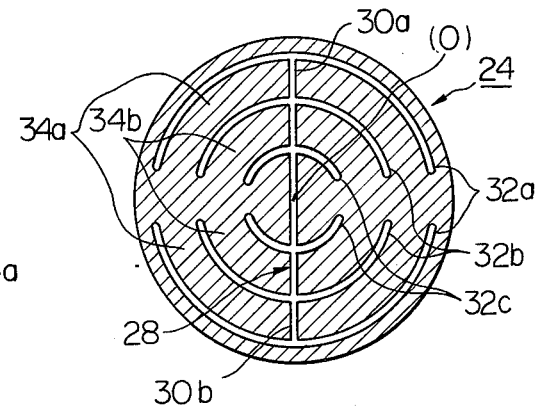
FIG. 3 is a cross-sectional view of the writing nib of the present invention taken along line III—III in FIG. 2.

Referring to FIGS. 2 and 3, the detailed construction of the writing nib 24 is shown according to the first embodiment of the present invention. The writing nib 24, which has a diameter, for example, of 0.8 mm, has an inner capillary conduit 28 extending axially therethrough. As shown in FIG. 3 the inner capillary conduit 28 forms, in a transverse cross section of the nib 24, two straight slits **30*a* and 30*b* each of which has a fine gap, for example, of 0.02 mm, which are conjoined with each other at the center (0) of the cross section. Each straight slit 30*a* and 30*b* extends toward the outer periphery of the nib 24 in the radial direction. In this embodiment the slits 30*a* and 30*b* are arranged 180° apart. The capillary conduit 28 also forms, in the transverse section of the nib 24, a plurality of radially spaced apart arc shaped slits 32*a*, 32*b* and 32*c*. Each of said spaced arc shaped slits is interconnected to one of the straight slits 30*a*, 30*b* at the middle portion thereof. As a result, spaced apart partitions 34*a* and 34*b* are formed along the axial direction of the nib 24 in a cantilever fashion. As a result of this arrangement of a plurality of slits 30*a*, 30*b*, and 32*a*, 32*b* and 32*c*, the total area of the cross section of the conduit 28 to the area of the cross section of the nib 24 — which is called "void ratio" — is large enough, for example 0.137, to maintain a sufficient amount of ink in the nib 24, while keeping the diameter of the nib 24** as small as 0.8 mm, for example.

As shown in FIG. 2, a tip portion **24*a* of the nib 24 is formed into a rounded shape, which, for example, can be obtained by a grinding operation. Therefore, the capillary conduit 28 is opened to the surface of the tip portion 24*b* of the nib 24**.

As shown in FIG. 2, the rear portion of said nib 24 at a distance from the rear end of the nib 24 is formed into a frust-conical shape, which can be obtained by a grinding operation. Therefore, in the rear end portion 24b of said nib 24, the capillary conduit 28 is opened to the surface of said frust-conical portion 25 and is opened along the longitudinal direction of the nib 24, so that introduction of ink from the ink reservoir 16 is eased.

When using the writing instrument according to the present invention no problem such as scratching occurs, because a sufficient amount of ink can be maintained in the capillary conduit 28 of the nib 24. As already mentioned the "void ratio" of the nib can be enlarged enough to keep a sufficient amount of ink while keeping the diameter of the nib small. Therefore, clear letters having a uniform thickness from beginning to end can be obtained, when using this pen.

In addition to the above mentioned advantage, the writing instrument of the present invention is easy to use because the tip portion 24a has a sufficient bending strength, due to the fact that a plurality of the inner partitions 34a and 34b having arc shaped cross sections, are formed along the axial direction of said nib 24.

According to the invention it is possible to write letters regardless of the angle between the nib and the paper, because the capillary conduit 28 is opened to the rounded surface 27 of the tip portion 24a.

Figure 4:
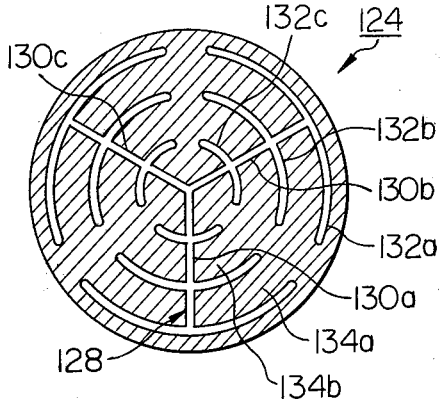
FIG. 4 is a cross-sectional view of a writing nib according to the second embodiment of the invention.

In the second embodiment of the present invention shown in FIG. 4, the nib 124 having an inner capillary conduit 128, in a transverse cross section of said nib, forms three straight slits 130a, 130b and 130c which are arranged 120° from each other and which are conjoined to each other at the center of the cross section, and forms a plurality of radially spaced apart arc shaped slits 132a, 132b and 132c. Each spaced arc shaped slit is interconnected to one of the straight slits 130a, 130b and 130c at the middle portion thereof. As a result, a plurality of radially spaced apart partitions 134a and 134b are formed along the axial direction of the nib.

In this second embodiment, the amount of ink contained in the nib 128 is much larger than that of the first embodiment, because the void ratio of the nib 124, may be enlarged to 0.183. However, a decrease of bending strength can be prevented because the number of the inner partitions in increased in comparison with the number in the first embodiment.

Figure 5:
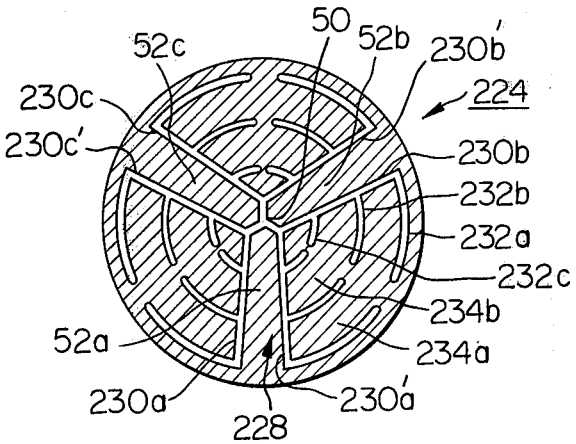
FIG. 5 is a cross-sectional view of a writing nib according to the third embodiment of the invention.

In the third embodiment shown in FIG. 5, a nib 224 has an inner capillary conduit 228 which extends axially and which, in the transverse cross section, forms three sets of two straight slits 230a and 230a', 230b and 230b', and 230c and 230c' which are arranged 120° to each other, each two straight slits being arranged substantially parallel to each other, in a close relationship. Each straight slit is conjoined to the other at the center of the cross section by an X-shaped slit 50. The conduit 228, further forms, in the cross section, a plurality of radially spaced apart arc shaped slits 232a, 232b and 232c which are coaxial to each other about the center of the cross section. Each arc shaped slit (232a, 232b and 232c) is interconnected to each other at one end thereof. As a result, a plurality of inner partitions 234a and 234b having an arc shape, and three equiangularly spaced inner partitions 52a, 52b and 52c are formed in the nib along the axial direction thereof.

As modifications of above-mentioned embodiment it is preferable to form a plurality of recesses on the surface of the inner partitions and nib, which extend to the axial direction of the nib to provide more effective capillary action of the inner capillary conduit of the nib.

The above described characteristic construction of the writing instrument of the present invention is not limited to the above-mentioned disclosure and drawings, and any modification thereof having the same function may be considered as being within the scope of the present invention.

What is claimed is:

1. In a writing instrument comprising a cylindrical casing having a rear end and a forward end axially spaced apart from each other, an ink reservoir in said casing, and a writing nib having its rear end in said ink reservoir and its forward end projecting from the forward end of said casing, said nib having a rounded tip portion extending forwardly from said forward end of the casing and having an inner capillary conduit which extends axially through the nib;

the improvement wherein said inner capillary conduit forms, in a transverse cross section of the nib, at least one straight slit which extends from the center of the cross section toward the outer periphery of the nib in the substantially radial direction of the cross section, and forms a plurality of radially spaced apart arc shaped slits which are coaxial with each other about said center, a part of each of said arc shaped slits interconnecting with said straight slit, said radially spaced apart arc shaped slits being opened to a rounded outer surface of the tip portion.

2. A writing instrument according to claim 1, wherein two straight slits which are conjoined with each other at the center of the cross section are arranged 180° to each other, and wherein each of said arc shaped slits is interconnected to each of said straight slits at the middle of said arc shaped slits.

3. A writing instrument according to claim 1, wherein three straight slits which are conjoined with each other at the center of the cross section are arranged 120° to each other, and wherein each of said arc shaped slits is interconnected to each of said straight slits at the middle of said arc shaped slits.

4. A writing instrument according to claim 1, wherein a plurality of sets of straight slits which are conjoined with each other at the center of the cross section are arranged 120° to each other, each two slits of each set being substantially parallel to each other in a close relationship, and wherein each of said spaced apart arc shaped slits is interconnected to one of two slits of each set at one end of each of said arc shaped slits.

* * * * *